US010118104B1

(12) United States Patent
Basyuk

(10) Patent No.: US 10,118,104 B1
(45) **Date of Patent: *Nov. 6, 2018**

(54) ROLL AND STAND-UP TOY AND A GAME USING THE SAME

(71) Applicant: Simon Basyuk, Millburn, NJ (US)

(72) Inventor: Simon Basyuk, Millburn, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/003,657

(22) Filed: Jun. 8, 2018

Related U.S. Application Data

(63) Continuation-in-part of application No. 15/669,897, filed on Aug. 5, 2017, now Pat. No. 10,010,786.

(51) Int. Cl.
*A63H 15/08* (2006.01)
*A63H 33/00* (2006.01)
*A63H 15/06* (2006.01)

(52) U.S. Cl.
CPC ..... *A63H 15/06* (2013.01); *A63H 15/08* (2013.01); *A63H 33/00* (2013.01); *A63F 2250/063* (2013.01)

(58) Field of Classification Search
CPC ..... A63H 15/08; A63H 33/02; A63H 33/005
See application file for complete search history.

(56) References Cited

U.S. PATENT DOCUMENTS 581,481 A * 4/1897 Leake ..... A63H 33/005 446/458
2,473,574 A * 6/1949 Davis ..... A63H 33/00 446/243
2,525,482 A * 10/1950 Grither ..... A63H 33/00 446/431
2,585,780 A * 2/1952 Whitaker ..... A63H 15/08 446/324
2,752,725 A * 7/1956 Unsworth ..... A63F 7/042 273/109
3,135,512 A * 6/1964 Taylor ..... A63F 7/044 273/109
3,451,671 A * 6/1969 May ..... A63B 26/003 280/228
4,213,266 A * 7/1980 Hyland ..... A63H 15/08 446/431

(Continued)

*Primary Examiner* — Gene Kim
*Assistant Examiner* — Alyssa Hylinski
(74) *Attorney, Agent, or Firm* — Walter J. Tencza, Jr.

(57) ABSTRACT

A rolling toy to be rolled on a horizontal support surface, for instance, on a floor, having a primary roller and a secondary roller. The primary roller having a tubular-like member extending along a longitudinal axis and at least one annular flange fixedly attached to the tubular-like member and extending outwardly therefrom. The secondary roller is adapted a for rolling motion upon an interior surface of the tubular-like member when the primary roller rotates about the longitudinal axis due to the rolling motion of the rolling toy on the horizontal support surface. At least one of the following includes a helical guiding means: (i) the tubular-like member and (ii) the secondary roller. Thereby, when the secondary roller is disposed on the interior surface of the tubular-like member and the primary roller is set in a rolling motion on the horizontal support surface in a predetermined direction, the rolling motion of the primary roller results in a tilting of the latter. The tilting of the primary roller may result in its standing vertically on the horizontal support surface.

20 Claims, 14 Drawing Sheets

(56) References Cited

U.S. PATENT DOCUMENTS 4,223,474 A * 9/1980 Strauss ..... A63H 33/00 446/221
4,501,569 A 2/1985 Clark, Jr.
4,595,369 A 6/1986 Downs
4,609,196 A * 9/1986 Bozinovic ..... A63B 43/04 446/437
4,720,283 A * 1/1988 Williams ..... A63F 7/3622 446/168
4,726,800 A 2/1988 Kobayashi
4,902,271 A 2/1990 Yoneda
4,925,428 A * 5/1990 Sonesson ..... A63B 43/04 446/324
5,058,901 A 10/1991 Salvino
5,525,118 A 6/1996 Mock
5,692,737 A 12/1997 Perlsweig
5,928,055 A * 7/1999 Gramsch ..... A63H 15/08 446/297
5,947,793 A 9/1999 Yamakawa
5,951,407 A 9/1999 Teitloff
6,027,412 A 2/2000 Pinel
6,227,933 B1 5/2001 Michaud
6,250,987 B1 6/2001 Choi
6,273,779 B1 8/2001 Boulaire
6,402,630 B1 6/2002 Tyer
6,485,349 B1 * 11/2002 Snyder ..... A63H 29/08 446/168
6,569,025 B1 5/2003 Tyler
6,645,037 B1 11/2003 Choi
7,640,894 B2 * 1/2010 Jager ..... A01K 15/026 119/710
7,753,804 B2 7/2010 Sposato
7,927,170 B2 4/2011 Bickerton
8,057,277 B2 11/2011 Sip
8,584,620 B2 * 11/2013 Rutherford ..... A01K 15/025 119/707
8,858,294 B2 10/2014 Mimlitch, III
8,894,465 B2 11/2014 McClintock
8,939,136 B2 1/2015 Gaus
9,352,237 B1 * 5/2016 Middleton ..... A63H 15/08
10,010,786 B1 * 7/2018 Basyuk ..... A63F 9/00
2011/0014849 A1 * 1/2011 Sip ..... A63H 17/262 446/457

* cited by examiner

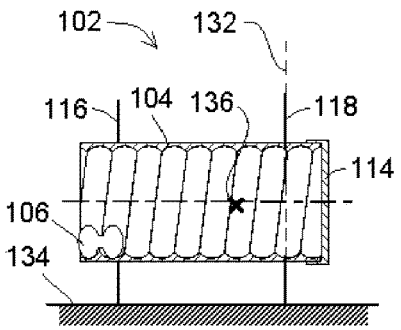
FIG. 4-A
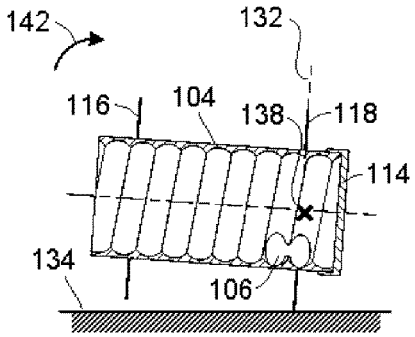
FIG. 4-B
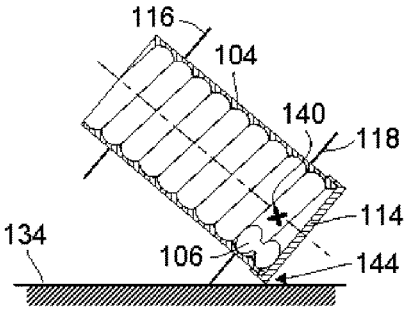
FIG. 4-C
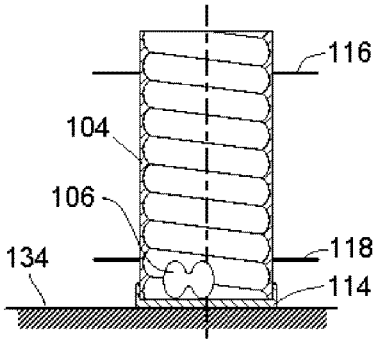
FIG. 4-D
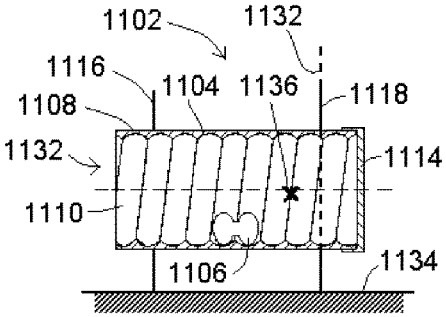
FIG. 11-A
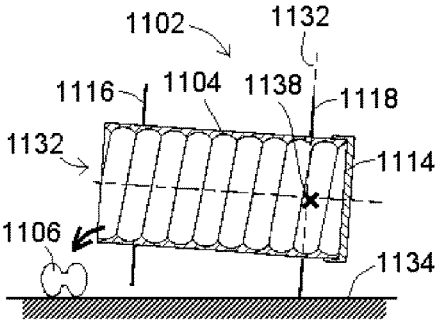
FIG. 11-B

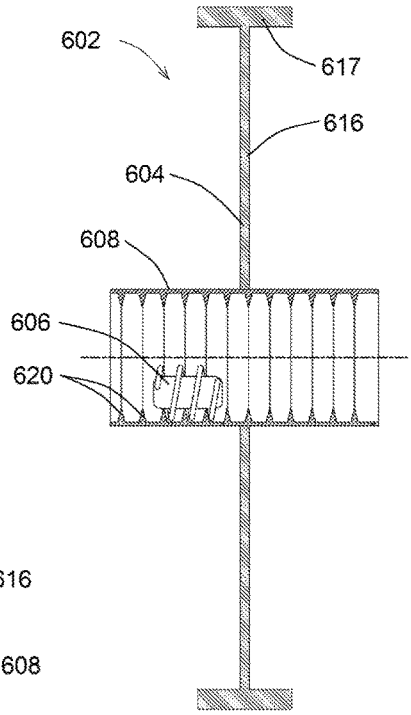
FIG. 12
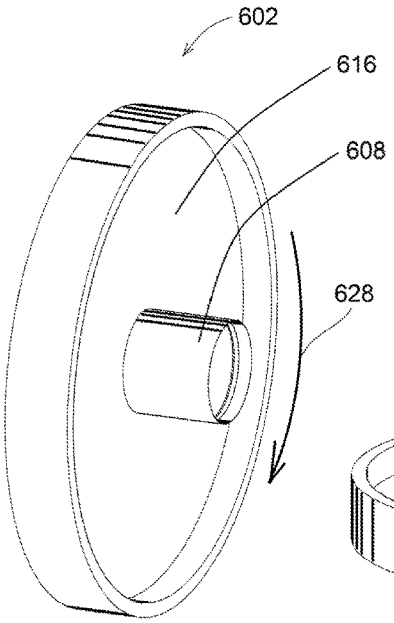
FIG. 13-A
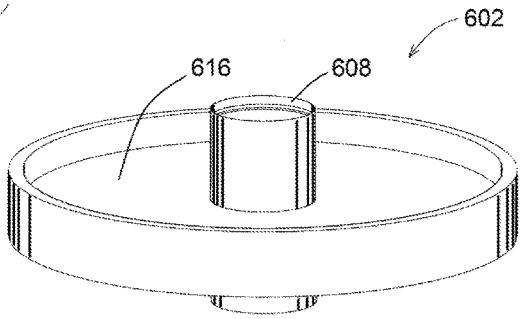
FIG.13-B

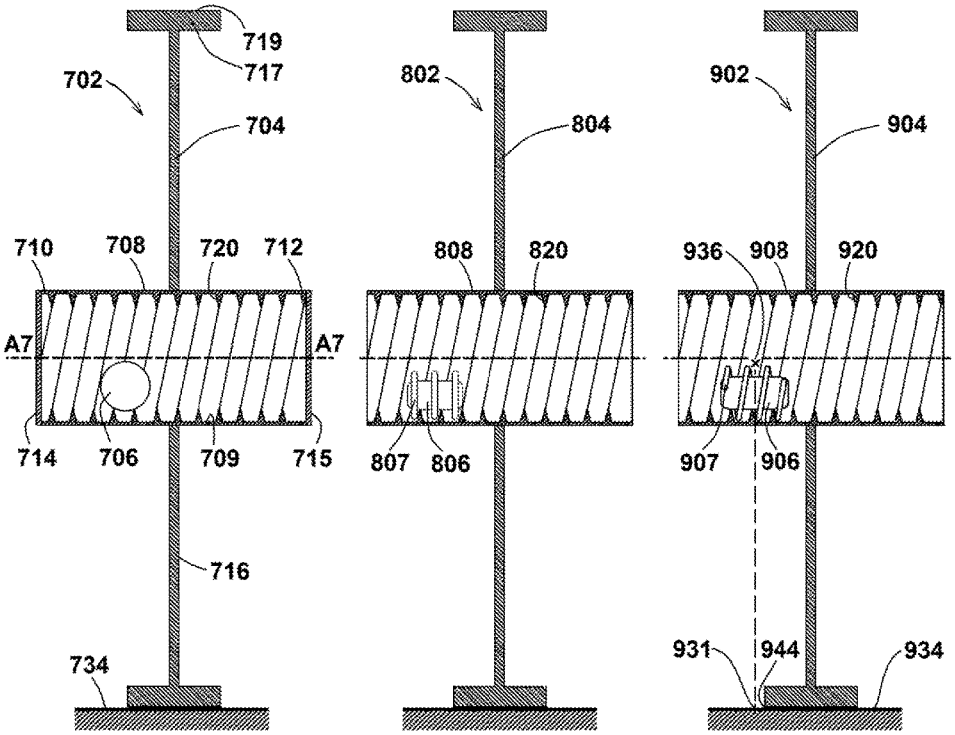
FIG. 14-A FIG. 14-B FIG. 14-C

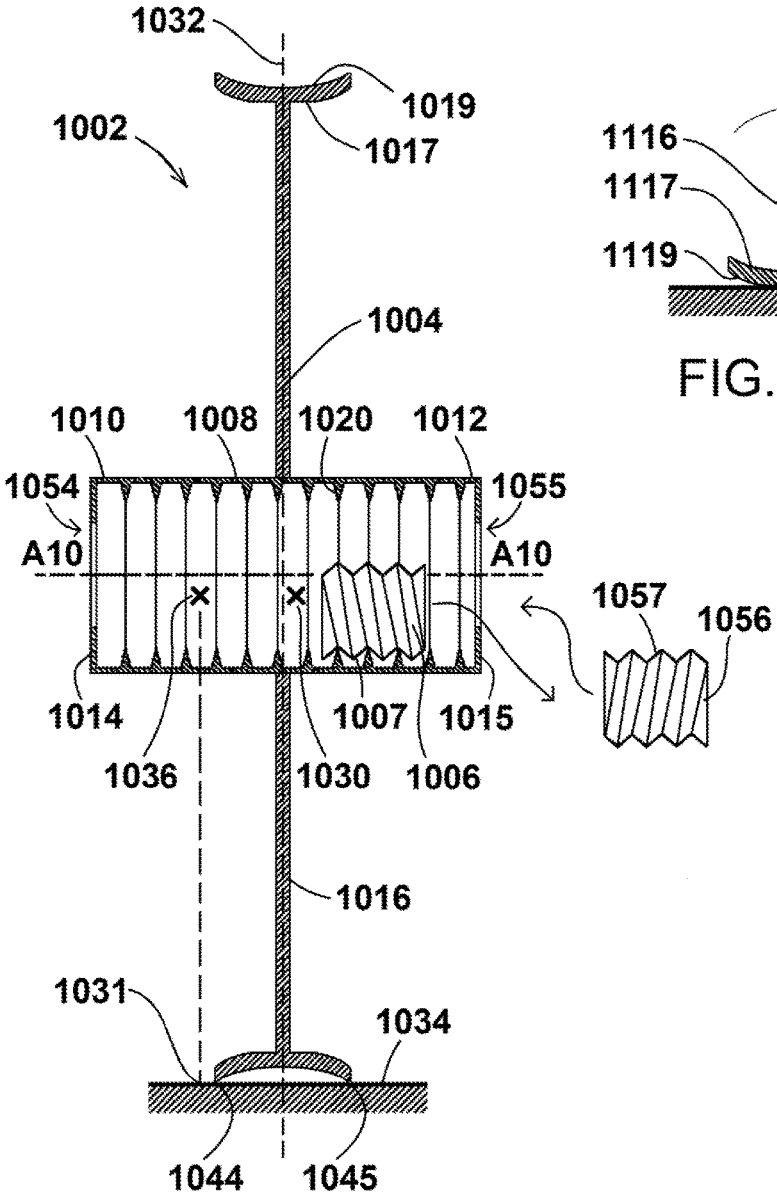
FIG. 15-A
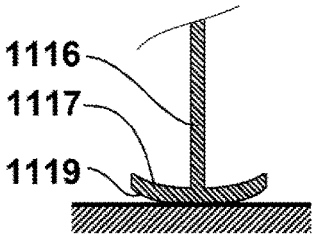
FIG. 15-B

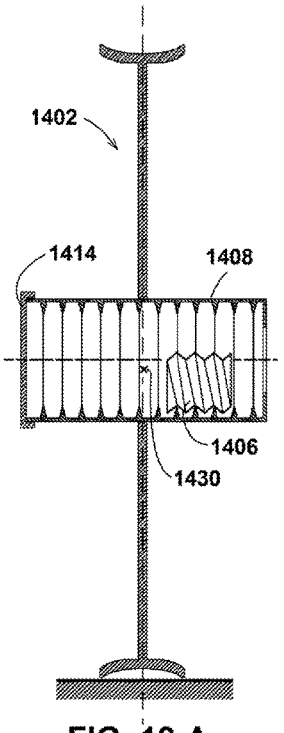
FIG. 19-A
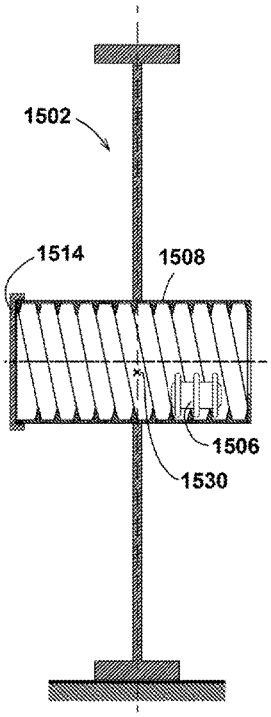
FIG. 19-B
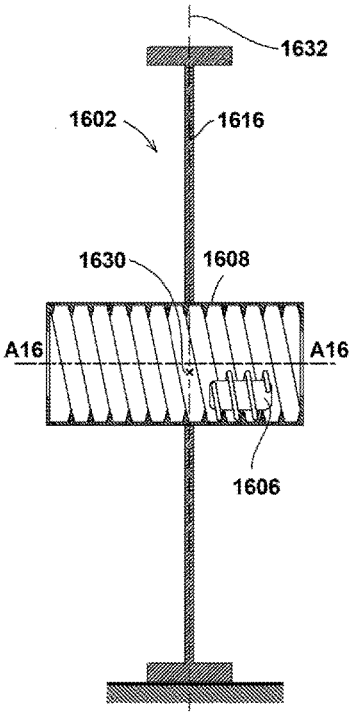
FIG. 19-C
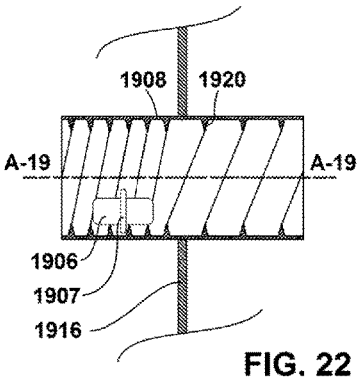
FIG. 22

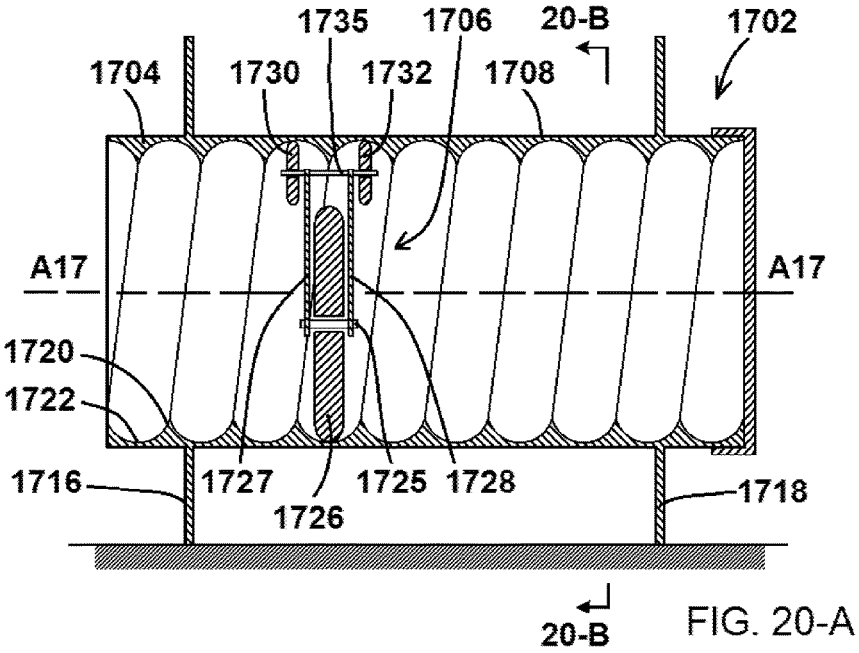
FIG. 20-A
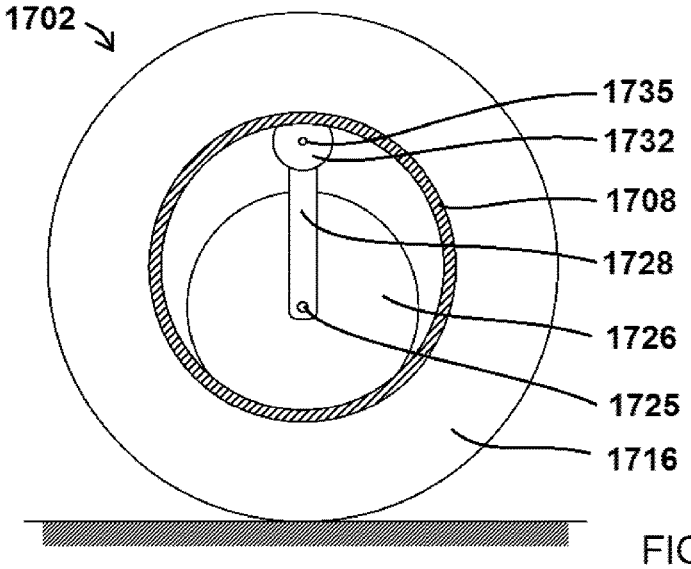
FIG. 20-B

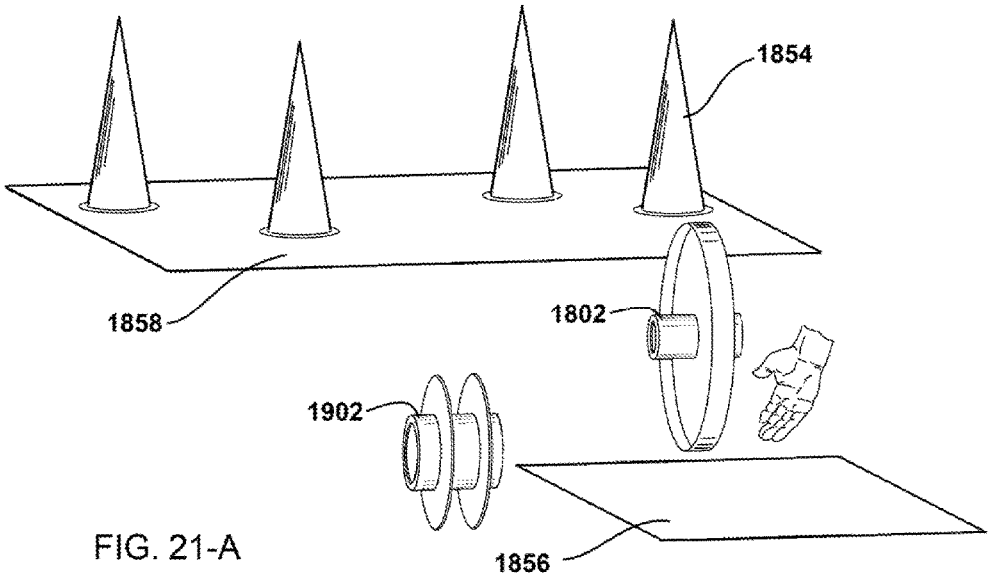
FIG. 21-A
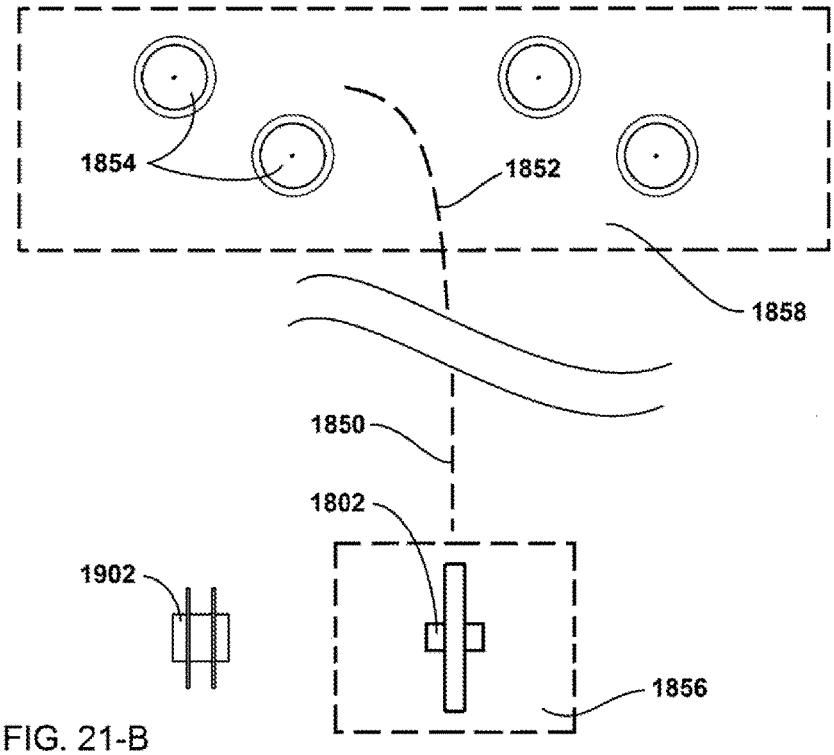
FIG. 21-B

ROLL AND STAND-UP TOY AND A GAME USING THE SAME

CROSS REFERENCE TO RELATED APPLICATION(S)

The present application is a continuation in part of and claims the priority of U.S. patent application Ser. No. 15/669,897, filed Aug. 5, 2017, titled "ROLL AND STAND-UP TOY AND A GAME USING THE SAME".

FIELD AND BACKGROUND OF THE DISCLOSED TECHNOLOGY

The present invention relates to toys and game apparatuses and, more particularly, to toys and game apparatuses that a user may roll.

One of popular in-door activity games is bowling. In bowling, a user rolls a ball toward a number of pins, and the ball rolls a considerable distance along the bowling alley. Complicated and expensive equipment is required for a bowling game, as well as a specialized facility where users can play the game. Those factors prevent bowling from being played at home.

A variety of rolling toys for children are known. By way of example, U.S. Pat. No. 6,485,349 to Snyder and others discloses a rolling toy having a tubular assembly with a ball moving within a tubular assembly positioned inside the tubular assembly. When a user makes the toy rolling, audio and video signals are generated due to a motion sensor incorporated into body of the toy. U.S. Pat. No. 5,947,793 to Yamakawa provides a self-propelling rolling toy which is able to change the route of rolling movement if an obstacle is encountered by the toy. Both of the cited patents have a relatively complicated structure. Moreover, there is a need of rolling-type games, similar to bowling, that can be played at home.

SUMMARY OF THE INVENTION

The object of the present invention is to provide a new rolling toy which, when being thrown or rolled by a user, will roll on a horizontal support surface, for a certain distance and then stands up by itself. The rolling distance depends on a preliminarily adjustment to the rolling toy made by the user. The toy may be utilized for a completely new game.

One aspect of the invention provides a rolling toy having a primary roller and a secondary roller. The primary roller has a tubular-like member extending along a longitudinal axis thereof between left end and right end. The primary roller has at least one annular flange fixedly attached to the tubular-like member. The at least one annular flange is configured such that the primary roller is rollable on the at least one annular flange on a horizontal support surface. The tubular-like member has a substantially cylindrical interior surface. The secondary roller is sized to fit within the tubular-like member and is adapted for a rolling motion on the cylindrical interior surface when the longitudinal axis is orientated horizontally and the primary roller is in a rotational motion about the longitudinal axis.

As to another aspect of the invention, at least one of the following includes a helical guiding means: the tubular-like member and the secondary roller. The helical guiding means is/are configured for urging the secondary roller to move longitudinally toward the left end or the right end when the secondary roller is in the rolling motion on the substantially cylindrical interior surface of the tubular-like member.

As to a further aspect of the invention, configurations of the primary and secondary rollers and weights of the rollers are such that, as the primary roller is positioned having the longitudinal axis oriented horizontally, at least one of the following is satisfied: (a) a center of gravity of the rolling toy is located to the left of a leftmost annular flange of the at least one annular flange when the secondary roller is disposed on the substantially cylindrical interior surface in close proximity to the left end, (b) the center of gravity of the rolling toy is located to the right of a rightmost annular flange of the at least one annular flange when the secondary roller is disposed on the substantially cylindrical interior surface in close proximity to the right end, (c) a center of gravity of the primary roller is located to the left of a leftmost annular flange of the at least one annular flange, and (d) the center of gravity of the primary roller is located to the right of a rightmost annular flange of the at least one annular flange.

As to a further aspect of the invention, the tubular-like member includes a support area located on the leftmost or the rightmost portion thereof and configured such that the primary roller is positionable on the support area on the horizontal support surface, thereby, the tilting of the primary roller may result in the standing thereof on the horizontal support surface.

BRIEF DESCRIPTION OF THE DRAWINGS

The preferred embodiments of the invention will hereinafter be described in conjunction with the appended drawings provided to illustrate and not to limit the invention, where like designations denote like elements, and in which:

FIGS. 4-A, 4-B, 4-C and 4-D are snapshots of the rolling toy rolling on the floor, view from the side;

FIGS. 11-A and 11-B are snapshots of the rolling toy rolling on the floor, where rotation is opposite to the one shown in FIG. 3;

FIG. 12 is a cross sectional view of a rolling toy illustrating the sixth embodiment ("single annular flange" schema);

FIGS. 13-A and 13-B are perspective views of a rolling toy illustrating the sixth embodiment, in the rolling and standing positions, correspondingly;

FIGS. 14-A, 14-B and 14-C are partial cross sectional views of a rolling toy in "single annular flange" schema with a tubular-like member having a helical ridge and secondary roller implemented as a ball, a cylindrical roller with interior ridges and a cylindrical roller with a helical ridge, respectively;

FIG. 15-A is a partial cross sectional view of a rolling toy in "single annular flange" schema with a tubular-like member having circular interior ridges and the secondary roller implemented as a cylindrical roller with a helical ridge;

FIG. 15-B shows a part of the annular flange of the rolling toy in "single annular flange" schema, with a convex rim, in cross sectional view;

FIGS. 19-A, 19-B and 19-C are partial cross sectional views of rolling toys of a single annular flange design;

FIGS. 20-A and 20-B are a partial cross sectional view and a view from the side of a rolling toy with multi-part secondary roller;

FIGS. 21-A and 21-B are illustrated a game which utilizes the rolling toys, in a perspective view and a view from above, respectively; and FIG. 22 shows a partial cross sectional view of a tubular-like member having a helical ridge with a variable pitch helix.

DETAILED DESCRIPTION OF THE PREFERRED EMBODIMENTS

Figure 1:
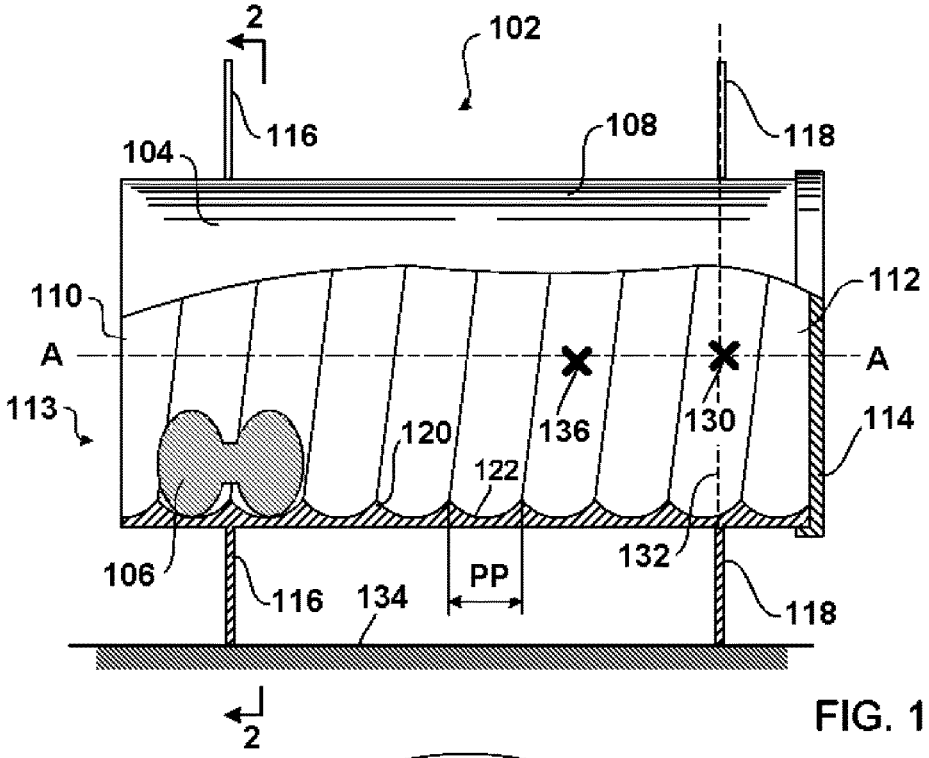
FIG. 1 is a partial cross sectional view of a rolling toy illustrating a first embodiment of the present invention.
Figure 2:
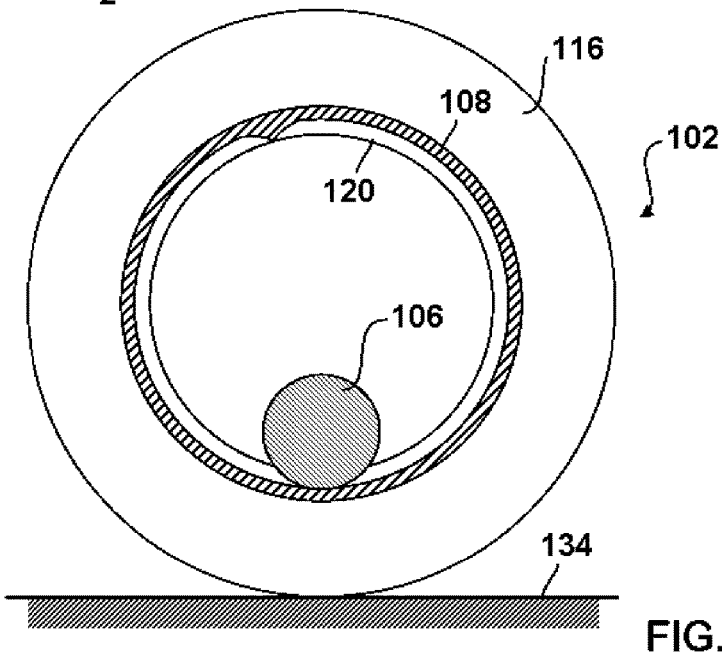
FIG. 2 is a cross sectional view of the rolling toy taken along the line 2-2 of FIG. 1.

Referring now to FIGS. 1 and 2, a rolling toy 102 according to a first embodiment of the present invention comprises a primary roller 104 and a secondary roller 106. The primary roller 104 comprises: a tubular-like member 108 made of a light-weight material and extending along a longitudinal axis A-A between left end 110 and a right end 112; a left annular flange 116 fixedly attached to the tubular-like member 108, extending radially outwardly thereof and positioned in the vicinity of the left end 110; a right annular flange 118 fixedly attached to the tubular-like member 108, extending radially outwardly thereof and positioned in the vicinity of the right end 112 and a counterweight which is implemented as a metal disk 114 fixedly attached to the tubular-like member 108 on the right end 112 thereof.

The tubular-like member 108 has an opening 113 in the left end 110. In FIG. 1 the left end 110 is on the left side and the right end 112 is on the right side; we will be using that convention throughout the present description. The left annular flange 116 and the right annular flange 118 have equal outer diameters and their axes coincide with the axis A-A. The primary roller 104 can roll on the annular flanges 116 and 118 upon a horizontal support surface 134, which can be, for instance, a floor.

The size, relative location and weight of the parts of the primary roller 104 are such that the center of gravity (COG) thereof is located in the position indicated by the cross 130: on the longitudinal axis A-A, close to an imaginary vertical plane 132 associated with the right annular flange 118. A light weight of the tubular-like member 108 and a heavy weight of the metal disk 114 define such location of the primary roller's COG.

A helical ridge 120 extends inwardly from a substantially cylindrical interior surface of the tubular-like member 108. The helical ridge 120 runs between the left end 110 and the right end 112. The helical ridge 120 forms a helical groove 122. As a way of example, the helical ridge 120 has a right hand helix; a pitch of the helix is marked in FIG. 1 as PP.

The secondary roller 106, preferably, has a shape of a dumbbell. A user initially holds the primary roller 104 so that axis A-A is oriented horizontally, then he/she places the secondary roller 106 inside the tubular-like member 108 through the opening 113 so that the secondary roller lays freely on the helical groove 122.

When the primary roller 104 is positioned on the horizontal support surface 134 and the secondary roller 106 lays on the helical groove 122 in the vicinity of the left end 110, COG of the rolling toy 102 (defined by a relative position, configuration and weights of the primary and secondary rollers) is located at the position indicated by the cross 136, between annular flanges 116 and 118. With that, projection of the rolling toy's COG on the support surface 134 lies between points of contact of the annular flanges with the support surface. Thereby, the rolling toy is in an equilibrium state. (When the secondary roller is positioned in the middle section of the tubular-like member, COG of the rolling toy is still located between the annular flanges). On the other hand, when secondary roller 106 lays on the helical groove 122 in the vicinity of right end 112, COG of the rolling toy lies to the right of the plane 132 which forces the rolling toy to tilt (this will be described in detail further). For simplicity, we'll be using the wording "the secondary roller inside the primary roller" instead of "the secondary roller inside the tubular-like member of the primary roller". It should be understood that shape of the secondary roller 106 can have a different than dumbbell; for instance, it can be shaped as a ball.

Figure 3:
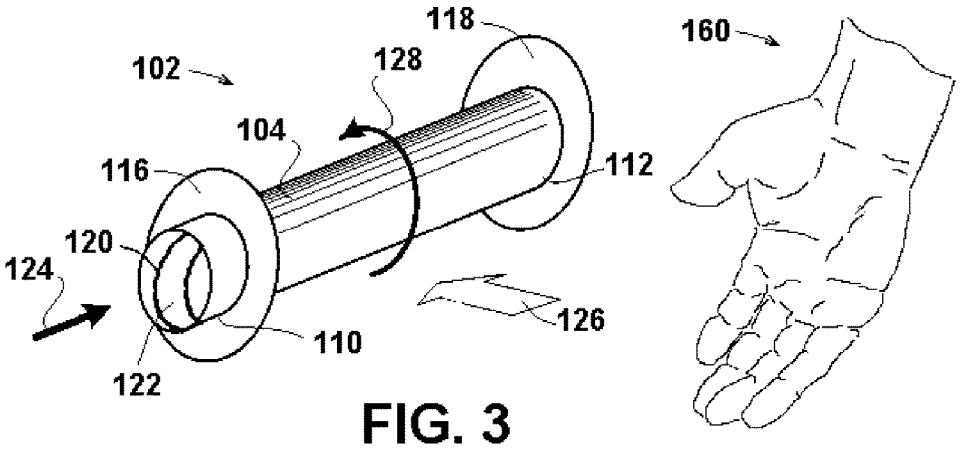
FIG. 3 is perspective view of the rolling toy which illustrates schematically directions of its rolling and rotation.

FIG. 3 illustrates how a user 160 plays with the rolling toy 102. Initially, while holding the rolling toy horizontally, he/she positions the secondary roller (not shown in FIG. 3) inside the primary roller 104 on the helical groove 122 near the left end 110. Then he/she rolls the rolling toy on the horizontal support surface. In the illustrated example, the left end 110 is on the left side relative to the user 160 and the primary roller 104 rolls in a direction indicated by arrow 126. Looking at the primary roller along its longitudinal axis from the left side, its rotation direction is counterclockwise as indicated by the curved arrow 128. When the primary roller is rolling, the secondary roller, which lies freely on the helical groove 122, remains in its lowest position (as illustrated in FIG. 1). Due to frictional engagement between their surfaces, the secondary roller is rolling upon the helical groove. As specified, the helical ridge 120 has a right hand helix, thereby, while the primary roller is rolling as illustrated in FIG. 3, the secondary roller moves longitudinally in the direction indicated by arrow 124, toward right end 112.

Four positions of the rolling toy 102 on the horizontal support surface are shown schematically in snapshots in FIGS. 4-A, 4-B, 4-C and 4-D. The notations used in these figures are the same as in FIG. 1. The snapshot FIG. 4-A illustrates a moment when the user initiates the primary roller's rolling. A location of the rolling toy's COG is indicated by the cross 136. With the primary roller rolling on the support surface and the secondary roller moving inside it in the rightward direction, COG of the rolling toy shifts rightward as well. Eventually, the COG reaches the location indicated by the cross 138, as illustrated in the snapshot FIG. 4-B. The location 138 of the COG lies to the right of the plane 132, which causes the rolling toy to lose its equilibrium state and to tilt in the direction indicated by the arrow 142.

Consequently, the rightmost circular edge of the metal disk 114 touches the horizontal support surface 134; the point of contact is marked as 144 in the snapshot FIG. 4-C. At this moment, the secondary roller is in the rightmost position inside the primary roller and COG of the rolling toy is located as indicated by the cross 140. Projection of the COG on the horizontal support surface lies to the right of the point of contact 144, so the rolling toy is still not in an equilibrium state and continues to tilt. That tilting ultimately cause the rolling toy to stand up vertically on the flat surface of the metal disk 114, as illustrated in the snapshot FIG. 4-D. The sadden termination of the rolling toy's rolling movement and changing of its orientation to vertical provides an amusement effect.

Figure 5:
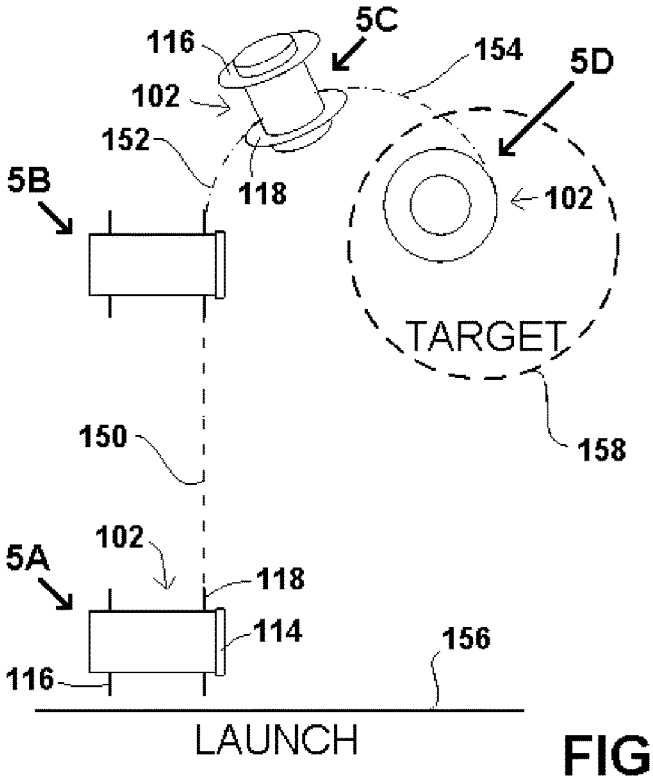
FIG. 5 shows snapshots of the rolling toy rolling on the floor, view from above.

Positions of the rolling toy 102, as they are seen from above, are illustrated in FIG. 5, where snapshots 5-A, 5-B, 5-C and 5-D correspond to the snapshots in FIGS. 4-A, 4-B, 4-C and 4-D, respectively. From the start of its rolling (snapshot 5-A), the rolling toy 102 rolls on two annular flanges along a straight line 150 until it starts tilting (snapshot 5-B). When the rolling toy starts tilting, the left annular flange 116 no longer touches the horizontal support surface. So the rolling toy rolls only on the right annular flange 118, along a curved line 152, until the rightmost circular edge of the metal disk 114 (see FIG. 4-C) touches the horizontal support surface as shown on the snapshot 5-C. Then the rolling toy rolls along the curved line 154 until it stands vertically, as illustrated in the snapshot 5-D.

A distance that the rolling toy rolls upon the support surface prior to standing up is, roughly:

$$\text{Dist_Roll}=3.14*\text{Diam_flange}*\text{Num_Rvl} \quad (1),$$

where Diam_flange is the outer diameter of the left and right annular flanges and Num_Rvl is the number of revolutions of the primary roller. In order to achieve the longest distance of the rolling toy rolling, the user initially disposes the secondary roller 106 inside the primary roller 104 in a position closest to left end 110 (see FIG. 1). Let us assume that the primary roller stops rolling when the secondary roller reaches the rightmost position on the helical groove 122. Correspondingly, a maximum number of the primary roller revolutions is approximately equal to number of coils of the helix, Num_Coils and the maximal distance which the rolling toy can rolls is:

$$\text{Dist_Roll_Max}=3.14*\text{Diam_flange}*\text{Num_Coils} \quad (2).$$

If the user places the secondary roller initially inside the primary roller 104 in a position closer to the right end, the distance of the rolling toy rolling is proportionally shorter than Dist_Roll_Max. For instance, if the initial position of the secondary roller is in the middle section of the primary roller then the rolling distance is twice shorter than Dist_Roll_Max.

Here is an example of the rolling toy design and dimensions. The helical ridge has ten coils. The pitch PP of the helix is 16 mm; a longitudinal length of the helix is 10*16 mm=160 mm. Outer diameter of the annular flanges is 130 mm. According to formula (2), distance Dist_Roll_Max is 4.1 m (about 13'). An inner diameter of the tubular-like member 108 is 50 mm. In general, according to our estimation, outer diameter of the annular flanges must be at least 25% larger than inner diameter of the tubular-like member.

Figure 6:
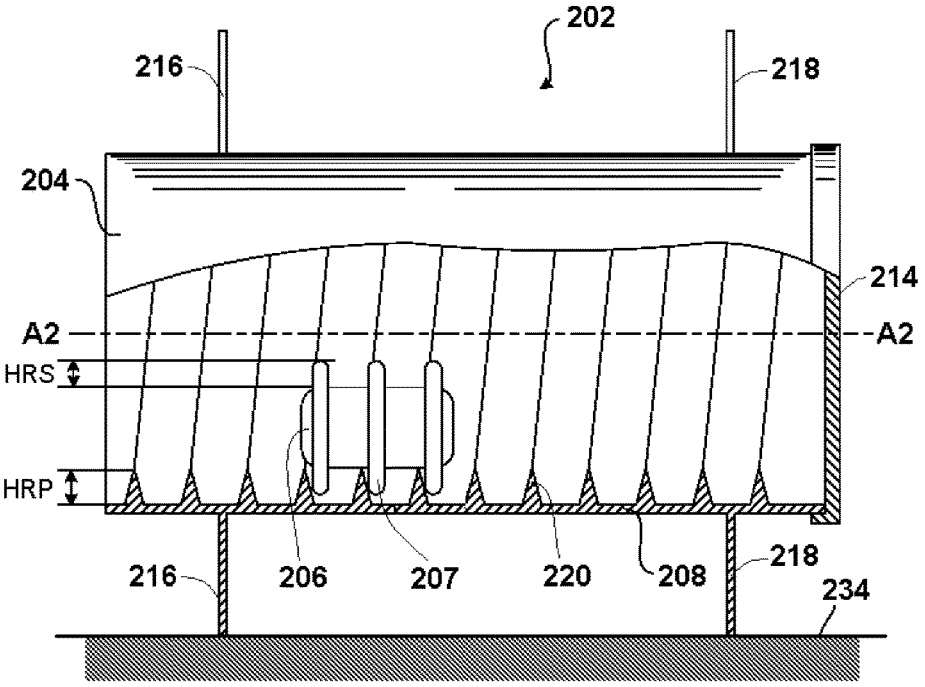
FIG. 6 is a partial cross sectional view of a rolling toy illustrating a second embodiment.

FIG. 6 illustrates a second embodiment of the rolling toy. Similar to the first embodiment, a rolling toy 202 comprises a primary roller 204 and a secondary roller 206. Primary roller 204 has a tubular-like member 208 extending along a longitudinal axis A2-A2, a left and a right annular flanges 216 and 218, correspondingly, and a counterweight which is implemented as a metal disk 214. A helical ridge 220 extends inwardly from the interior surface of the tubular-like member 208. The secondary roller 206 is formed as an elongated cylindrical roller with several circular ridges 207 extending outwardly. The secondary roller 206 is disposed inside the tubular-like member 208. Heights HRS of the circular ridges 207 are slightly smaller than heights HRP of the helical ridge 220 so the secondary roller lays on the helical ridge 220 when the primary roller 204 is oriented horizontally. Due to the frictional engagement between the exterior of the secondary roller 206 and the helical ridge 220, the secondary roller rolls upon the helical ridge when the primary roller rolls upon a support surface 234. It should be understood that configuration of secondary roller 206, primary roller 204 and its helical ridge 220 can be different from those shown in FIG. 6. For instance, the secondary roller may have only one circular ridge.

Figure 7:
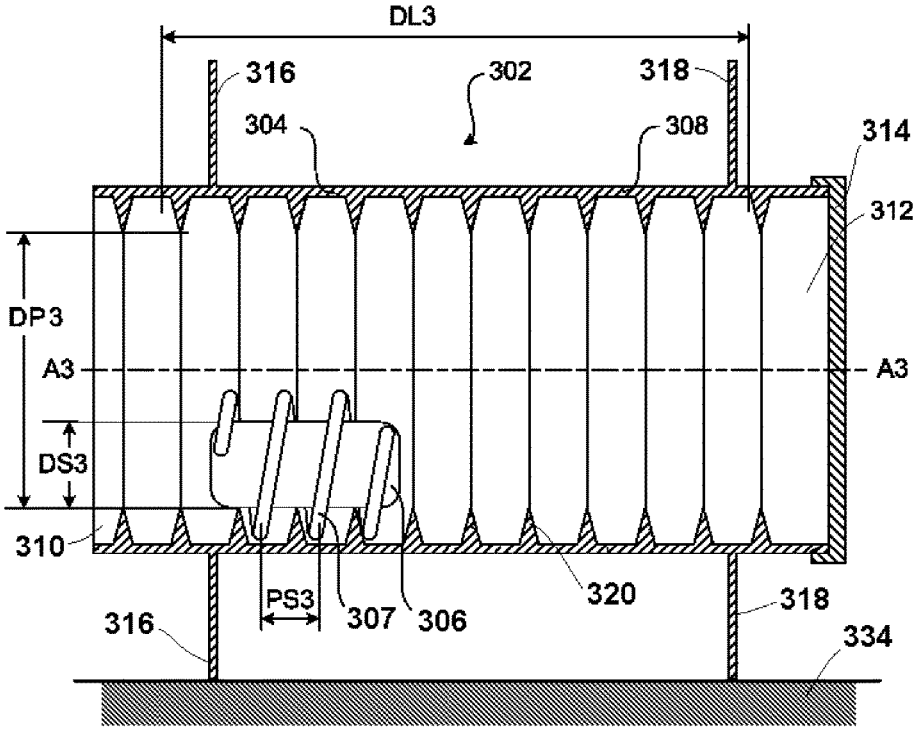
FIG. 7 is a partial cross sectional view of a rolling toy illustrating a third embodiment.

FIG. 7 illustrates a third embodiment of the rolling toy. Similar to the first embodiment, a rolling toy 302 comprises a primary roller 304 and a secondary roller 306. Primary roller 304 has a tubular-like member 308 extending along a longitudinal axis A3-A3 between a left end 310 and a right end 312. A plurality of equidistantly spaced apart circular interior ridges 320 are extending inwardly from the interior surface of the tubular-like member 308. The interior ridges 320 are coaxial with the axis A3-A3, their internal diameters are equal. The secondary roller 306 is formed as an elongated cylindrical roller with a helical ridge 307 extending outwardly from the cylindrical surface thereof. The helical ridge 307 has a left-hand helix. The pitch of the helix is marked in FIG. 7 as PS3. The distance between two adjacent interior ridges 320 is equal to the pitch of the helical ridge helix. The primary roller 304 has a left annular flange 316, a right annular flange 318 and a counterweight which is implemented as a metal disk 314.

When a user holds the primary roller 304 horizontally, he/she positions the secondary roller 306 on the interior ridges 320, close to the left end 310. When the primary roller rolls upon a support surface 334, the secondary roller 306 remains in the lowest position. Due to frictional engagement between the secondary roller and the interior ridges 320, the secondary roller rolls upon the interior ridges. Similar to the first embodiment, when the primary roller 304 rotates in the direction illustrated in FIG. 3 by arrow 128, the secondary roller 306 moves longitudinally in the direction indicated by arrow 124 because of engagement between helical ridge 307 and interior ridges 320. The longitudinal movement of the secondary roller 306 from left to right results in a shift of the rolling toy's COG and a corresponding tilt thereof when the secondary roller reaches the right end 312.

It should be understood that configuration of the primary and secondary rollers can be different than the configuration shown in FIG. 7. For instance, the distance between two adjacent interior ridges 320 can be twice longer than the pitch of the helical ridge helix. Also, the tubular-like member 308 can have multiple holes in its wall in order to make it lighter. The secondary roller can be formed as a helical spring.

Here is an assessment of the rolling toy's dimensions according to the third embodiment. A maximal distance DL3 of the longitudinal movement of the secondary roller 306 inside the primary roller 304 during the rolling toy's rolling is roughly:

DL3=NR3*PS3*DP3/DS3, where NR3 is a maximal number of revolutions of the primary roller 304; DP3 is the inner diameter of interior ridges 320 and DS3 is a diameter of the secondary roller's 306 cylindrical body. As an example: NR3 is equal to ten; the pitch PS3 is 10 mm; diameter DP3 is 50 mm and diameter DS3 is 30 mm. With that, the distance DL3 is 167 mm. Correspondingly, a full length of the primary 304 roller along the axis A3-A3 is about 220 mm.

Figure 8:
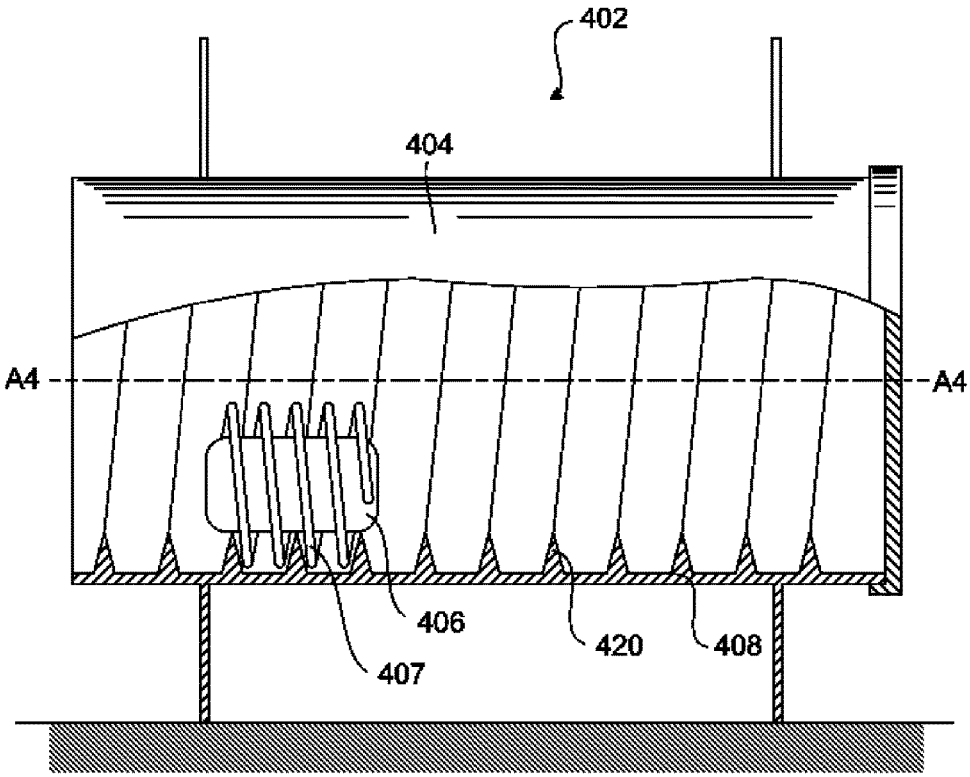
FIG. 8 is a partial cross sectional view of a rolling toy illustrating a fourth embodiment ("two helixes" schema)

FIG. 8 illustrates a fourth embodiment of the rolling toy. This is essentially a "two helixes" schema, a combination of the second and third embodiments. A rolling toy 402 comprises a primary roller 404 and a secondary roller 406. The primary roller 404 has a generally cylindrical tubular-like member 408 extending along a longitudinal axis A4-A4. A helical ridge 420 extends inwardly from an interior surface of the tubular-like member 408. The secondary roller 406 is formed as a cylindrical roller with a helical ridge 407 extending outwardly from the cylindrical surface therefrom. The helical ridge 420 and the helical ridge 407 both have right hand helixes.

When the primary roller 404 rotates in the direction illustrated in FIG. 3 by arrow 128, the secondary roller 406 moves longitudinally inside the primary roller in rightward direction a distance of DL4, which can be calculated roughly as:

$$DL4=NR4*(PP4-PS4*ID4/DS4),$$

here: NR4 is the number of revolutions of primary roller 404, PP4 is a pitch of the primary roller's helical ridge 420, PS4 is a pitch of the secondary roller's helical ridge 407, ID4 is an inner diameter of the primary roller's helical ridge 420, DS4 is a diameter of the secondary roller's cylindrical body.

With the specified configuration of the helixes and direction of the primary roller's rotation, the helical ridge 420 causes the longitudinal movement of the secondary roller 406 rightward, while the helical ridge 407 causes the longitudinal movement of the secondary roller 406 leftward. Thereby, a configuration of both rollers in which the "rightward-moving" component PP4 is slightly greater than the "leftward-moving" component PS4*ID4/DS4, provides a slow longitudinal movement of the secondary roller in the rightward direction. This provides for a longer distance of the rolling toy's rolling (more rotations) with a smaller number of coils of the helical ridge 420 and, correspondingly, smaller longitudinal size of the primary roller.

Figure 9:
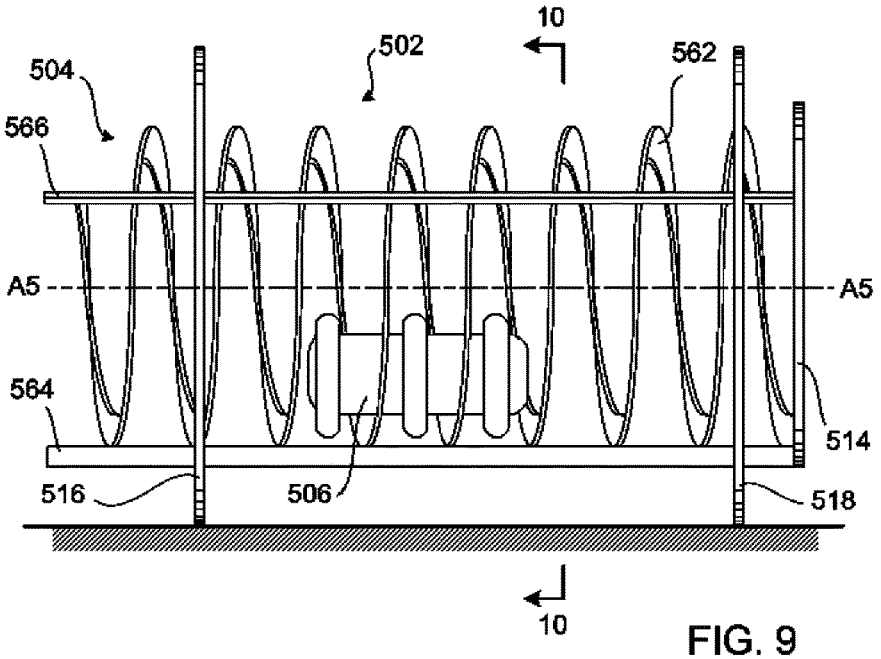
FIG. 9 is a side view of a rolling toy illustrating a fifth embodiment.
Figure 10:
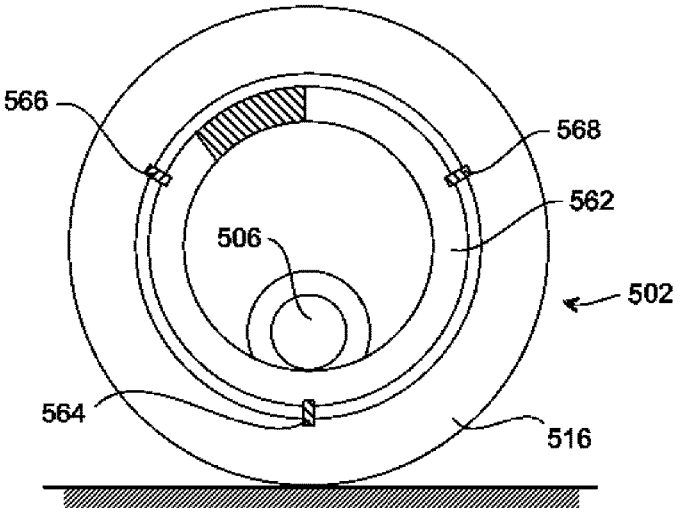
FIG. 10 is a cross sectional view of the rolling toy taken along the line 10-10 of FIG. 9.

Configuration of the primary roller of the rolling toy can be different from those described in the previous embodiments. For instance, FIGS. 9 and 10 illustrate a fifth embodiment, which is a variation of the second embodiment. Here, a rolling toy 502 comprises a primary roller 504 and a secondary roller 506. The primary roller 504 has a tubular-like member, which is implemented as a helical spring 562 extending along a longitudinal axis A5-A5. (The helical spring 562 has a configuration of a stretched Slinky toy). Three bars 564, 566 and 568 are attached to the exterior portions of the helical spring's coils. The bars are parallel to the longitudinal axis A5-A5. A left and a right washer-shaped flanges 516 and 518 are attached to the bars; the flanges 516 and 518 have equal outer diameters and their axes coincide with the axis A5-A5. A metal disc 514 is attached to the bars in their rightmost portions. The secondary roller 506 has a configuration similar the one of the secondary roller 206 (see FIG. 6). The secondary roller 506 is positioned in the interior of the helical spring 562 so that it lays freely on the coils thereof.

It is should be understood that the rolling toy can be used when the secondary roller moves longitudinally in the direction from right to left, which is opposite to the direction in the embodiments described hereinabove. Such a mode of operation is illustrated in FIGS. 11-A and 11-B. A rolling toy 1102, essentially identical to the one illustrated in FIGS. 1 and 2, comprises of a primary roller 1104 (having a tubular-like member 1108, a left annular flange 1116, a right annular flange 1118 and a counterweight which is implemented as a metal disk 1114), and a secondary roller 1106. An imaginary plane 1132 is associated with the right annular flange 1118. A helical ridge 1120 having a right hand helix extends inwardly from the interior surface of the tubular-like member 1108. In the primary roller's left end 1110 there is an opening 1113. As illustrated in FIG. 11-B, a primary roller's COG, marked as a cross 1138, is located slightly to the right of the plane 1132. Initially, a user places the secondary roller 1106 inside the tubular-like member 1108 in the middle portion thereof as shown in FIG. 11-A. With that, the rolling toy 1102 is in an equilibrium state when it stands on a support surface 1134. A COG of the rolling toy (as a combination of the primary and secondary rollers) is marked in FIG. 11-A as a cross 1136. The rolling toy's COG lies between the annular flanges 1116 and 1118; a projection of the COG on the support surface lies between the points of contact of the annular flanges with the support surface.

The user rolls the rolling toy on the support surface 1134 such that the primary roller 1104 rotates clockwise, looking at it along its longitudinal axis from the left side (the rotation is opposite from the one shown in FIG. 3 by the arrow 128). With that rotation, the secondary roller 1132 moves longitudinally in the leftward direction. Eventually, the secondary roller reaches the left end 1110 and falls on the support surface 1134 from the primary roller through the opening 1113. As the result, the primary roller loses its equilibrium state (due to location of its COG) and starts tilting as illustrated in FIG. 11-B. Then, in the same way as described hereinabove for the first embodiment, the primary roller stands up vertically on the flat surface of the metal disk 1114.

FIGS. 12, 13-A and 13-B illustrate a sixth embodiment of the rolling toy: a "single annular flange" schema. As illustrated in the cross sectional view FIG. 12, the rolling toy 602 comprises a primary roller 604 and a secondary roller 606. Primary roller 604 has a tubular-like member 608. A single annular flange 616 directly joints the tubular-like member 608 in the middle section thereof. The annular flange 616 has a rim 617. Similar to the third embodiment described hereinabove, a plurality of equidistantly spaced apart circular interior ridges 620 are extending inwardly from the interior surface of the tubular-like member 608. The secondary roller 606 is formed as a cylindrical roller with a helical ridge extending outwardly from the cylindrical surface thereof. The helical ridge has a left-hand helix.

When the primary roller 604 rolls upon a horizontal support surface as illustrated in the FIG. 13-A (direction of the primary roller rotation is marked by arrow 628), the secondary roller 606 moves in the rightward direction. When the rotation speed slows down and the secondary roller approaches the right end of the tubular-like member 608, the primary roller 604 tilts to the right and then falls on the support surface as it illustrated in the FIG. 13-B. A secondary roller with a right-hand helix can be utilized in this embodiment as well. With the right-hand helix, the secondary roller will move in the leftward direction when the primary roller rotates as illustrated in the FIG. 13-A and, correspondingly, the primary roller will tilt to the left when the secondary roller approaches the left end of the tubular-like member 608.

It should be understood that in the "single annular flange" schema, a different configuration of the tubular-like member and the secondary roller can be utilized Similar to the second embodiment, the interior surface of the tubular-like member may have a helical ridge (rather than the spaced apart circular interior ridges), and the secondary roller may have circular ridges extending outwardly its body. Another option might be the "two helixes" schema as in the fourth embodiment of the invention.

It should be understood also that directions of the helixes in the all of embodiments described hereinabove were selected by way of example. For instance, in the first embodiment, the helical ridge has a right hand helix. Therefore, under the conditions illustrated in FIG. 3, the secondary roller moves inside the primary roller longitudinally in the rightward direction. However, if the helical ridge of the primary roller had a left-hand helix, then the user would need to roll it in the opposite direction in order to make the secondary roller to move longitudinally in the rightward direction. Similarly, in the third embodiment the secondary roller can have a helical ridge with a right-hand helix; in the fourth embodiment ("two helixes" schema), both helixes can have the same (either both left or both right) or opposite directions. Also, multiple helixes can be utilized instead of a single helix in the primary rollers and/or in secondary rollers in the described embodiments.

It is also should be understood that shape, material and relative location of the parts of the rolling toy can be different from those described and illustrated hereinabove. For example, in the first embodiment, the secondary roller can have a spherical or semi-spherical shape. The tubular-like member can have, for instance, a shape of a barrel or slightly concave cylinder rather than a straight cylinder. Further, the annular flanges not necessarily have to be flat. For instance, instead of right annular flange described hereinabove, a rolling body of a semi-spherical shape, coaxial with the tubular-like member and fixedly attached thereto may be utilized. Further, the counterweight can be implemented, for instance, as a ring attached to outer surface of the right end section of the tubular-like member; the counterweight can be made of a non-metal material. The tubular-like member may have no openings on either of its ends so that the secondary roller could not be removed from the tubular-like member. Also, the primary roller in the embodiments described hereinabove can be implemented without the counterweight. In such implementation, the secondary roller must be heavy enough to cause the primary roller tilting to the left or to the right when the secondary roller is in the left end or in the right end of the primary roller, correspondingly.

A game that may be played on a substantially flat horizontal surface, for instance, on a floor, utilizing the rolling toy described hereinabove is contemplated. The game players, or one player, initially mark designated areas on the floor using a chalk or an adhesive tape: LAUNCH and TARGET, as shown in FIG. 5. By way of example: a line 156 defines the LAUNCH area and a circle 158 defines the TARGET area; the diameter of the TARGET area is 3 feet (0.9 m) and the distance between the LAUNCH and TARGET areas (between the line 156 and the circle 158) is 10 feet (3 m). The players are allowed to roll their rolling toys from the LAUNCH area. The goal of the game is to roll the rolling toy so that it ends up standing vertically inside the TARGET area. The challenge for the players in the game is to aim the rolling toy correctly and to choose a proper initial position of the secondary roller inside the primary roller (because the rolling toy's rolling distance depends on the initial position). Also, the players may have to consider previously launched rolling toys which may already occupy the TARGET area and those rolling toys which may stand between the LAUNCH and the TARGET areas. The players may be allowed to roll more than one rolling toy. It is to be understood that different rules of the game can be contemplated, for instance multiple LAUNCH and TARGET areas can be utilized.

Referring now to FIG. 14-A, a rolling toy 702 according to an embodiment of the present invention comprises a primary roller 704 and a secondary roller 706. Primary roller 704 has a tubular-like member 708 extending along a longitudinal axis A7-A7 between left end 710 and a right end 712. A single annular flange or rolling body 716 directly joins the tubular-like member 708 in the middle section thereof. The annular flange 716 has a rim 717 with a substantially cylindrical outer/rolling surface 719. Primary roller 704 can roll on the annular flange 716 upon a horizontal support surface 734, which can be, for instance, a floor or a lawn's ground.

A helical ridge 720 extends inwardly from a substantially cylindrical interior surface of the tubular-like member 708. The helical ridge 720 runs between the left end 710 and the right end 712. By way of example, the helical ridge 720 is formed as a right hand helix. Secondary roller 706 is a ball preferably made of a heavy material, which may weigh, for example two hundred and thirty grams (eight ounces), whereas the primary roller 704 may weigh somewhat more at two hundred and eighty grams (ten ounces). The secondary roller may preferably be made of steel, and is disposed inside tubular-like member 708. The relative of weights of the secondary roller 706 and the primary roller 704 may be critical, in at least one embodiment, to provide proper operation of the rolling toy 702. Secondary roller 706 is sized to lay freely on the helical ridge 720 when longitudinal axis A7-A7 of the tubular-like member is oriented horizontally. Both, a pitch of the helical ridge's helix, height of the ridge 720 and diameter of the secondary roller 706 are such that the secondary roller 706 sits deep enough between two adjacent coils of the helical ridge 720 in order to prevent the secondary roller 706 from jumping inadvertently between the coils of the helical ridge 720. Tubular-like member 708 has two disc-shaped walls 714 and 715 which are attached to left end 710 and the right end 712, respectively. The walls 714 and 715 are intended to prevent secondary roller 706 from escaping from tubular-like member 708 when longitudinal axis A7-A7 of the tubular-like member is tilted relative to the horizontal. Similarly to the rolling toy embodiment illustrated in FIGS. 1-3, a user initially holds the primary roller 704 so that axis A7-A7 is oriented horizontally, such as parallel to horizontal surface 734. Then he/she rolls rolling toy 702 on the horizontal support surface 734. With that, secondary roller 706, supported by two adjacent coils of the helical ridge 720 inside tubular-like member 708, rolls on helical ridge 720. Thereby, the rolling of rolling toy 702 on the horizontal support surface results in a longitudinal movement of secondary roller 706 along axis A7-A7 in the direction from left end 710 toward right end 712.

It should be understood that design of the rolling toy can be different from the one described hereinabove. For example, helical ridge 720 can be not as high as illustrated in FIG. 14-A (or diameter of secondary roller 706 can be smaller relatively to the pitch of the helical ridge) so that the secondary roller 706 lays on a cylindrical portion 709 of interior surface of tubular-like member 708 between two adjacent coils of the helical ridge 720. Such design also provides an engagement of the secondary roller 706 with the helical ridge 720 when the primary roller 704 is rolling on the support surface 734 causing the secondary roller 706 to move longitudinally along axis A7-A7.

FIGS. 14-B and 14-C illustrate embodiments of the rolling toy which are similar to the one illustrated in FIG. 14-A with exception of the of secondary roller's shape. The rolling toys 802 and 902 have primary rollers 804 and 904, respectively, with tubular-like members 808 and 908 which, in turn, have helical ridges 820 and 920, respectively. The rolling toy 802 has a secondary roller 806 which is formed as an elongated cylindrical roller with at least one circular ridge 807 extending outwardly. The rolling toy 902 has a secondary roller 906 formed as an elongated cylindrical roller with a helical ridge 907 extending outwardly. That is essentially the "two helixes" schema similar to the one illustrated in FIG. 7. Pitch of the helical ridge 907 of secondary roller 906 is preferably equal to the pitch of the helical ridge 920 of primary roller 904. However, pitch of the ridge 907 can be, for instance, twice bigger or twice smaller than the pitch of the ridge 920. FIGS. 14-B and 14-C are cross sectional views of respective primary rollers 804 and 904, however secondary rollers 806 and 906 are shown not sectioned.

FIG. 15-A illustrates a rolling toy 1002 similar to the one illustrated on FIG. 12. A primary roller 1004 has a tubular-like member 1008 extending along a longitudinal axis A10-A10 between left end 1010 and a right end 1012. A single annular flange or rolling body 1016 directly joints the tubular-like member 1008 in the middle section thereof. Because of that, center of gravity (COG) of primary roller 1004 is located on a vertical plane 1032, perpendicular to longitudinal axis A10-A10, and associated with annular flange 1016, in the point of intersection of the axis A10-A10 with the plane 1032. The vertical plane 1032 is essentially a plane of symmetry of the primary roller 1004.

Figure 16:
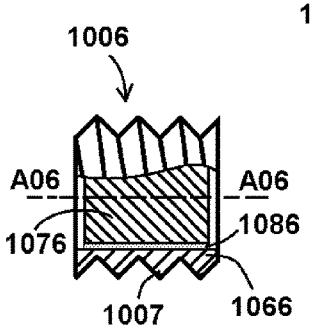
FIG. 16 is a partial cross sectional view of the secondary roller illustrated in FIG. 15-A.

In the described embodiment, annular flange or rolling body 1016 has a rim 1017 with a concave outer/rolling surface 1019. The tubular-like member 1008 has an array of circular interior ridges 1020 extending inwardly from an interior surface thereof and two barrier flanges 1014 and 1015 extending inwardly and attached to the left end 1010 and a to right end 1012, respectively. Barrier flanges 1014 and 1015 constitute a left opening 1054 and a right opening 1055, respectively. The rolling toy 1002 has a secondary roller 1006 that has a cylindrical body with a helical ridge 1007 extending outwardly (a detailed design of the secondary roller 1006 is illustrated in FIG. 16 and described hereinbelow). Secondary roller 1006 lays freely on edges of interior ridges 1020 when tubular-like member 1008 is oriented horizontally, parallel to a horizontal support surface 1034. Barrier flanges 1014 and 1015 are intended to prevent the secondary roller 1006 from falling from the tubular-like member 1008 when longitudinal axis A10-A10 of the tubular-like member 1008 is tilted relative to the horizontal of surface 1034. Outer diameter of helical ridge 1007 is slightly smaller than diameter of the openings 1054 and 1055 so that a user can remove secondary roller 1006 from the tubular-like member 1008 through either of the openings.

When rolling toy 1002 stands on the horizontal support surface 1034 so that axis A7-A7 is oriented horizontally, there are two points of contact of the annular flange's rim 1017 with the support surface: point 1044 and point 1045. Considering that rolling toy 1002 consists of the primary and secondary rollers, location of rolling toy's COG is defined by weights of primary roller 1004 and secondary roller 1006 and by location of the secondary roller 1006 inside tubular-like member 1008. With secondary roller 1006 positioned not far from vertical plane 1032, COG of the rolling toy 1002 is located close to the vertical plane 1032 too; such location of the rolling toy's COG is marked as a cross 1030. A projection of the COG on the support surface 1034 lies between the points of contact 1044 and 1045.

By way of example, helical ridge 1007 of secondary roller 1006 is formed as a right hand helix. When the user rolls the rolling toy 1002 on the horizontal support surface 1034, the secondary roller 1006 moves longitudinally along axis A10-A10 in the left direction due to engagement of the helical ridge 1007 with interior ridges 1020. As the result of the rolling toy 1002 rolling and longitudinal movement of the secondary roller 1006 to the left, COG of the rolling toy 1002 will be shifting to the left too. At some point of the rolling toy's rolling, secondary roller 1006 will be at a location in the left portion of tubular member 1008 such that COG of the rolling toy 1002 will be in a position marked as a cross 1036. In this case, a point of projection of the COG on the support surface 1034 lies to the left of point of contact 1044 as indicated in FIG. 15-A by the corresponding dashed line. The point of projection of the COG on the support surface 1034 is marked my numeral 1031. Consequently, the rolling toy 1002 will tilt to the left and its path of rolling will be a curve bent to the left. (Compare with the path of rolling toy 102 with right turn illustrated in FIG. 5).

A path of rolling toy 1002 rolling on the support surface 1034 is illustrated in FIG. 21-B in a view from above. When the user starts rolling the rolling toy and an initial position of secondary roller 1006 is such as illustrated in FIG. 15-A, (the rolling toy's COG is in location 1030), the rolling toy 1002 rolls first along a straight line 1850. That is because primary roller 1004 rolls on two points of contact upon the support surface 1034 and longitudinal axis A10-A10 is oriented horizontally. Essentially, the straight rolling lasts while the projection of the rolling toy's COG on the support surface 1034 (constantly shifting to the left) lies between points of contact 1044 and 1045. Then the rolling toy 1002 will tilt and turn to the left as explained hereinabove. If an initial position of secondary roller 1006 inside tubular member 1008 is close enough to right end 1012 then the rolling toy 1002 starts rolling along a curve line 1852 which bends to the right because the initial location of the rolling toy's COG (to the right from point of contact 1045) causes it to tilt to the right. Similarly to the rolling toy embodiments described previously, the user chooses a proper initial position of the secondary roller 1006 inside the tubular-like member 1008 in order to provide a desired distance of the rolling toy's rolling (and to some extent, the curvature of the rolling path).

Here is an assessment of the rolling toy 1002 dimensions, similarly to the one done previously for rolling toy 302 illustrated in FIG. 7. A distance DL10 of the longitudinal movement of secondary roller 1006 inside tubular-like member 1008 during the rolling toy's rolling is roughly:

$$DL10=NR10*PS10*DP10/DS10,$$

where NR10 is a number of revolutions of the primary roller 1004; DP10 is the inner diameter of interior ridges 1020, DS10 is the diameter of the secondary roller's 1006 cylindrical body and PS10 is a pitch of helical ridge 1007 helix. As an example: number of revolutions NR10 is equal to ten; the pitch PS10 is 6 mm; diameter DP10 is 60 mm and diameter DS10 is 40 mm. With that, the distance DL10 is 90 mm. Correspondingly, a length of tubular-like member 1008 along axis A10-A10 can be about 150 mm. With an outer diameter of rim 1017 equal to 300 mm (12"), a length of a path which the rolling toy covers when making ten rotations is 9.4 meters (31').

A factor which affects the rolling toy's path is the rotational inertia of the primary roller 1004. As it is known from physics, rotational inertia of a rotating body causes the resistance to change the orientation of an axis of rotation. Rotation inertia of rotating rim is proportional to mass of the rim multiplied by its radius squared. Thereby, if rim 1117 is too heavy and its radius is too big, then the shift of the rolling toy's COG caused by the longitudinal movement of the secondary roller 1006 has a little effect on the rolling toy's rolling along a straight line longer.

There is a substitution secondary roller 1056 available for the user. Secondary roller 1056 is equivalent to secondary roller 1006 in terms of its weight and size, except its helical ridge 1057 is formed as a left hand helix. The user can remove secondary roller 1006 from tubular-like member 1008 through either of the openings 1054 and 1055 and place secondary roller 1056 inside the inner chamber within member 1008, instead, positioning the secondary roller 1056 on the interior ridges 1020. By that, when the user rolls the rolling toy 1002 on horizontal support surface 1034, secondary roller 1056 moves longitudinally along axis A10-A10 in the right direction due to engagement of the helical ridge 1057 with interior ridges 1020. Correspondingly, the rolling toy 1002 will be tilting to the right and making a right turn when the user rolls it on the support surface. As an alternative to changing the secondary roller 1056 in the rolling toy 1002, two rolling toys can be provided: one containing secondary roller 1006 and another containing secondary roller 1056, one of the respective rolling toys will possess the left-turn and the right-turn features. In this case, the secondary rollers, in at least one embodiment, can be concealed inside their respective tubular-like members so there is no necessity to provide the openings 1054 and 1054.

It should be understood that, when designing a rolling toy in accordance with one or more embodiments of the present invention, weights of primary and secondary rollers and their respective configuration and sizes must be chosen properly in order to provide the rolling toy's movement/dynamics as described hereinabove. For instance, tubular-like member 1008 must have a sufficient length and secondary roller 1006 must have a sufficient weight in order to ensure a location of the rolling toy's COG which would cause its tilting. As an example: full length of tubular-like member 1008 along axis A10-A10 is 150.0 mm (6"), outer diameter of rim 1017 is 300.0 mm (12"), distance between any of two adjacent interior ridges 1020 is 15.0 mm; total weight of primary roller 1004 is 340.0 g (12.0 oz), and the weight of secondary roller 1006 is 400.0 g (14 oz). The relative weights and dimensions of various components are critical in at least one embodiment to the proper operation of the rolling toy 1002.

Further, it should be understood that the above description of the rolling toy's dynamics is applicable to different designs of the rolling toy with single annular flange according to the present invention. For instance, it is applicable to rolling toy 902 illustrated on FIG. 14-C. Here, secondary roller 906 is disposed on the helical ridge 920 inside tubular-like member 908 in a location in the left portion thereof. A corresponding location of a COG of the rolling toy 902 is marked as a cross 936. The point of projection of COG 936 on the support surface 934 is marked by numeral 931. For that exemplary position of secondary roller 906, projection of the COG on the support surface 934 lies to the left of point of contact 944 which would urge rolling toy 902 to tilt to the left.

Still further, it should be understood that the shape of the outer (rolling) surface of the single annular flange can be different than the shapes illustrated in FIG. 15-A and FIG. 12. As an example, FIG. 15-B shows a cut from an annular flange or rolling body 1116, which has a rim 1117 with a convex outer surface 1119. Obviously, the path of the rolling toy's rolling is affected by the shape of the rim's outer surface. For instance, a rolling toy having the rim 1119 as per FIG. 15-B runs a longer distance along a curved line and a shorter distance along a straight line comparing with the rolling toy with the rim 1017 as per FIG. 15-A.

FIG. 16 shows in detail the secondary roller 1006 as per FIG. 15-A. Secondary roller 1006 has a hollow body 1066 of a substantially cylindrical shape extending along an axis A06-A06. Hollow body 1066 is made preferably from a plastic material. An outer portion of hollow body 1066 is shaped as helical ridge 1007. A heavy core 1076 is inserted into the interior of cylindrical body 1066 and affixed to the inner surface thereof by a layer of a glue 1086. The core 1076 is made of a heavy material, preferably steel.

An example of the secondary roller 1006 configuration is as follows: hollow body 1066 internal diameter is 39.0 mm, length is 45.0 mm, outer diameter of helical ridge 1007 is 47.0 mm, pitch of the helix is 5.0 mm, number of coils: 9; the heavy core is a cut of a steel rod, diameter is 38.0 mm (1.5"), length 44.0 mm, and the weight 400.0 g (14 oz). In at least one embodiment, dimensions, weight, including relative dimensions and weights are critical for proper operation of the rolling toy 1002.

Figure 17:
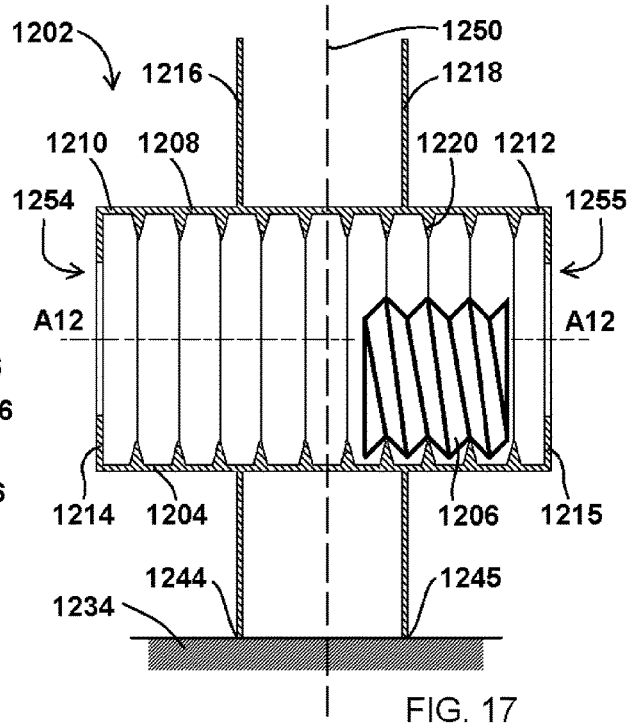
FIG. 17 is a partial cross sectional view of a rolling toy with two spaced apart annular flanges, tubular-like member having circular interior ridges and the secondary roller implemented as a cylindrical roller with a helical ridge.

FIG. 17 illustrates an embodiment of a rolling toy 1202 with two spaced apart annular flanges 1216 and 1218 and symmetrical weight distribution. The rolling toy 1202 comprises a primary roller 1204 and a secondary roller 1206. The primary roller 1204 comprises:

a tubular-like member 1208 extending along a longitudinal axis A12-A12 between left end 1210 and a right end 1212;

two spaced apart annular flanges 1216 and 1218 fixedly attached to the tubular-like member 1208 and extending radially outwardly thereof: left annular flange 1216 and right annular flange 1218; the annular flanges have equal outer diameter and are coaxial with the longitudinal axis A12-A12.

Primary roller 1204 is symmetrical with respect to a vertical plane 1250 which is perpendicular to longitudinal axis A12-A12 and intersects tubular-like member 1208 in a middle section thereof; annular flanges 1216 and 1218 are located at the same distance from the vertical plane 1250. COG of primary roller 1204 is located on or close to a vertical plane 1250. Secondary roller 1206 has a cylindrical body with a helical ridge 1207 extending outwardly. By way of example, helical ridge 1207 has a right-hand helix. Secondary roller 1206 is substantially similar to secondary roller 1006 illustrated in FIG. 16.

Tubular-like member 1208 has an array of circular interior ridges 1220 extending inwardly from an interior surface thereof and two barrier flanges 1214 and 1215 extending inwardly and attached to the left end 1212 and a to right end 1212, respectively. Barrier flanges 1214 and 1215 constitute a left opening 1254 and a right opening 1255, respectively. Secondary roller 1206 lays freely on edges of interior ridges 1220 when tubular-like member 1208 is oriented horizontally. Barrier flanges 1214 and 1215 are intended to prevent the secondary roller 1206 from falling from the tubular-like member 1208 when longitudinal axis A12-A12 of the tubular-like member 1208 is tilted relative to the horizontal. Outer diameter of helical ridge 1207 is slightly smaller than the diameter of the openings 1254 and 1255 so that a user can remove secondary roller 1206 from the tubular-like member 1208 through either of the openings.

Features and dynamics of rolling toy 1202 are similar to the ones of rolling toy 1002 illustrated in FIG. 15-A. The difference is obviously in the number of annular flanges, however, if we disregard that difference and consider points of contact 1244 and 1245 of rolling toy 1202 as being "equivalent" to points of contact 1044 and 1045 of rolling toy 1002, then the description of features and dynamics of rolling toy 1002 as hereinabove is applicable to rolling toy 1202. For instance, a substitution secondary roller, similar or identical to secondary roller 1056 with a helical ridge which helix has an opposite direction can be utilized in rolling toy 1202 in order to add the feature of two-ways (left and right) turning.

Figure 18:
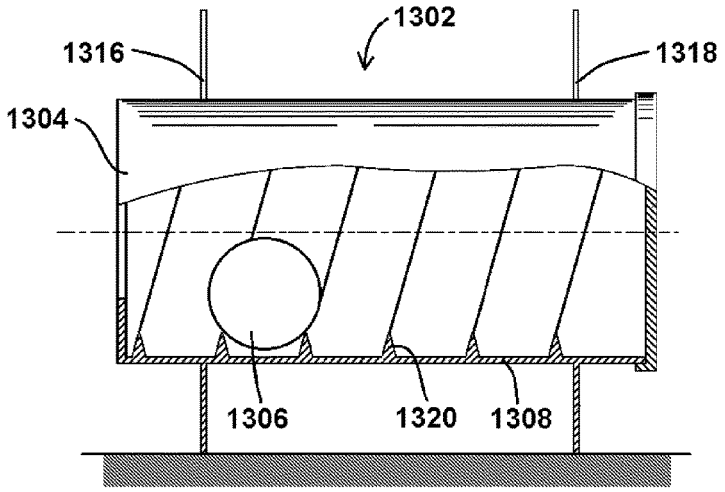
FIG. 18 is a partial cross sectional view of a rolling toy with two spaced apart annular flanges, a tubular-like member having a helical ridge and a secondary roller implemented as a ball.

FIG. 18 illustrates a rolling toy 1302 comprising a primary roller 1304 and a secondary roller 1306; the primary roller 1304 has a tubular-like member 1308 with two spaced apart and extending outwardly annular flanges 1316 and 1318 and a helical ridge 1320 extending inwardly from an interior surface of the tubular-like member 1308. Secondary roller 1306 is formed as a ball. Rolling toy 1302 is substantially similar to the rolling toy 102 illustrated in FIGS. 1 and 2 with exception of the of secondary roller's shape: a dumbbell in secondary roller 106 and a ball in secondary roller 1306. (FIG. 18 is a cross sectional views of respective primary roller 1304, however secondary roller 1306 is shown not sectioned).

FIGS. 19-A, 19-B and 19-C illustrate embodiments of a rolling toy 1402, 1502 and 1602, respectively, of a single annular flange design. Rolling toys 1402 and 1502 have a counterweight 1414 and 1514 respectively, fixedly attached to left end of a tubular-like member 1408 and 1508, respectively. Each of the counterweights 1414 and 1514 is preferably implemented as metal disk and is intended to balance the weight of the respective secondary rollers 1406 and 1506, respectively when the rollers 1406 and 1506, respectively, are located in the right portion of the respective tubular-like members 1408 and 1508. (Normally, when using a "left-turning" rolling toy with a single annular flange, a user places secondary roller in the right portion of the tubular-like member prior to launching the rolling toy). Rolling toy 1602 has a tubular-like member 1608 with an annular flange or rolling body 1616 attached thereto, and a secondary roller 1606. The flange 1616 is attached to tubular-like member 1608 in such a way that a portion of the tubular-like member 1608 to the left of the flange 1616 is longer than a portion of the tubular-like member 1608 to the right of the flange 1616.

In each of the rolling toys 1402, 1502 and 1602, when the respective secondary roller is located in a location in the right portion of the respective tubular-like member, COG of the rolling toys is located on a respective vertical plane associated with the respective secondary roller and perpendicular to a longitudinal axis of the respective tubular-like member. For instance, for the rolling toy 1602, when secondary roller 1606 is in a predetermined location in the right portion of tubular-like member 1608, a COG 1630 of the rolling toys is located on a vertical plane 1632 associated with annular flange 1616 and perpendicular to a longitudinal axis A16-A16 of the tubular-like member. For rolling toys 1402 and 1502, respective COGs are in a location 1430 and 1530 for the exemplary position of the respective secondary rollers 1406 and 1506.

It should be understood that design of the rolling toy's secondary roller can be different from the designs described hereinabove. For instance, a rolling toy 1702 with a secondary roller 1706 having a multi-part design is illustrated in FIGS. 20-A and 20-B. Rolling toy 1702 further has a primary roller 1704 which in turn has a tubular-like member 1708 extending along a longitudinal axis A17-A17 and two annular flanges 1716 and 1718 fixedly attached to the tubular-like member 1708 and extending outwardly thereof. A helical ridge 1720 extends inwardly from a substantially cylindrical interior surface of the tubular-like member 1708. Helical ridge 1720 forms a helical groove 1722.

Secondary roller 1706 contains a heavy roller 1726, for example the weight of roller 1726 may be 25% of the total weight of primary roller 1704, and these weights and/or relative weights between roller 1726 and primary roller 1704 are critical in at least one or more embodiments for proper operation of rolling toy 1702.

The roller 1726 is adapted for a rolling motion on helical groove 1722. Heavy roller 1726 has an axle 1725 and is rollable thereabout. Two light rods 1727 and 1728 of equal length are connected to opposite ends of axle 1725. There is a second axle 1735 connected to the opposite ends of rods 1727 and 1728. Secondary roller 1706 further contains two small stabilizing wheels 1730 and 1732 of equal diameter, which are mounted on opposite ends of axle 1735. The length of rods 1727 and 1728 as well as outer diameters of heavy roller 1726 and stabilizing wheels 1730 and 1732 are such that, when the heavy roller sits in the groove 1722, the stabilizing wheels touch the upper, opposite portions of the groove 1722. The "opposite portions of the groove" here means that points of contact of stabilizing wheels 1730 and 1732 with groove 1722 are located along the helical ridge 1720 at +180 and −180 degree, respectively, from point of contact of heavy roller 1726 with groove 1722. Thereby, when heavy roller 1726 rolls upon groove 1722, stabilizing wheels 1730 and 1732 roll in the groove as well, in "upside down" position. That improves stability of the secondary roller 1706 rolling motion inside tubular-like member 1708. For instance, if a rolling toy described in one of the previous embodiments rolls over a bump by a chance, the resulting jolt can cause the secondary roller to jump from one position inside the tubular-like member to another, which would affect the movement of the rolling toy. The stabilizing wheels of the rolling toy 1702 prevent such inadvertent jumping of secondary roller 1706.

A game that may be played on a substantially flat horizontal surface, for instance, on a floor or on a lawn, utilizing the rolling toy of embodiments described and illustrated hereinabove is illustrated in FIGS. 21-A and 21-B. The game players (or one player), initially place light plastic cones 1854 in the game area 1858 located at a pre-defined distance from the launch area 1856. The players are allowed to roll their rolling toys from the launch area 1856. The goal of the game is to roll the rolling toy, which may be any of the rolling toys previously described in the present application, toward the game area 1858 so that it knocks down a cone or several cones of cones 1854 while rolling. A challenge for players of the game is to aim the rolling toy correctly and to choose a proper initial position of the secondary roller inside the tubular-like member. The player is supposed to take into consideration the curved path of the rolling toy's rolling. Both types of rolling toys described hereinabove can be utilized in the game: a rolling toy 1802 with a single annular flange, and a rolling toy 1902 with two annular flanges. One of the rolling toys rolls first along a straight line 1850 shown in FIG. 21-B then that particular rolling toy starts rolling along a curve line 1852 which bends to the left due to a particular configuration of the rolling toy, as it was described hereinabove for rolling toy 1002, FIG. 15-A (bending to the right is feasible as well).

According to our estimation, in order to ensure a sufficient tilting of primary roller relative to the support surface, in one or more embodiments, described above, it is critical that the outer diameter of the annular flange/flanges be at least 25% larger than a diameter of an imaginary cylinder associated with the substantially cylindrical interior surface of the tubular-like member.

It should be understood that directions of the helixes in both, primary and secondary rollers in the all of embodiments described and illustrated hereinabove were selected by way of example. Shape of helical ridges in tubular-like bodes and in secondary rollers as well as shape of the interior ridge can be different than illustrated on the respected drawings. Further, multiple helixes can be utilized instead of a single helixes in all embodiments described above. Still further, left position of the rolling toy's parts (for instance, position of the secondary roller or the counter-weight) in the described embodiments can be changed to right position and vice versa. Still, further, an annular flange in the described embodiments can be implemented as a rolling body of a shape quite different than those illustrated in the corresponding drawings of the current invention. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

It should be understood that helical ridge on both, primary and secondary rollers may have a variable pitch helix. As an example, FIG. 22 shows a cut from a rolling toy with a tubular-like member 1908 extending along a longitudinal axis A19-A19, an annular flange 1916 and a cylindrical secondary roller 1906 with a single circular ridge 1907 extending outwardly from an exterior thereof. A helical ridge 1920 is extending inwardly from an interior surface of tubular-like member 1908. As illustrated, a pitch of the helical ridge 1920 is bigger in the right portion thereof than in the left portion. Secondary roller 1906 lays freely on edges of the helical ridge 1920. When the tubular-like member 1908 is in a rotational motion (caused by rolling of the rolling toy), secondary roller 1906 rolls on helical ridge 1920 and simultaneously is in a longitudinal movement along axis A19-A19 due to engagement of circular ridge 1907 with helical ridge 1920. Direction of the longitudinal movement is from left to right, as the helical ridge in this example has a right hand helix. Due to the variation of the helix' pitch, a speed of that longitudinal movement is higher when the secondary roller 1906 is in the right potion of the tubular-like member than when the roller is in the left portion thereof. Correspondingly, a tilting of the rolling toy to the right occurs more rapidly at the end of its rolling path.

I claim:

1. A rolling toy comprising:

a primary roller and a secondary roller;

said primary roller has a tubular member extending along a longitudinal axis thereof between a left end and a right end;

said primary roller further has at least one rolling body fixedly attached to said tubular member and is coaxial thereto;

said at least one rolling body is configured such that said primary roller is rollable on the at least one rolling body on a horizontal support surface;

said tubular member has a substantially cylindrical interior surface facing an interior thereof;

said secondary roller is sized to fit within said tubular member and is adapted for a rolling motion on said substantially cylindrical interior surface;

wherein at least one of the following includes a helical guiding means: (i) said tubular member and (ii) said secondary roller;

said helical guiding means includes at least one complete revolution of the helix thereof and is configured for urging said secondary roller to move longitudinally toward said left end or said right end when said secondary roller is in the rolling motion on said substantially cylindrical interior surface;

a configuration of the primary roller and weights of the primary and secondary rollers are such that, when said primary roller is positioned on said horizontal support surface having said longitudinal axis oriented horizontally, at least one of the following is satisfied:

(a) when said secondary roller is disposed on said substantially cylindrical interior surface in a position closest to said left end of said tubular member, a center of gravity of said rolling toy is located to the left of a vertical plane, perpendicular to said longitudinal axis, and crossing a leftmost point of contact of said at least one rolling body with said horizontal support surface, (b) when said secondary roller is disposed on said substantially cylindrical interior surface in a position closest to said right end of said tubular member, a center of gravity of said rolling toy is located to the right of a vertical plane, perpendicular to said longitudinal axis, and crossing a rightmost point of contact of said at least one rolling body with said horizontal support surface;

thereby, when said secondary roller is disposed on said substantially cylindrical interior surface in a predetermined location and said primary roller is set in a rolling motion on said horizontal support surface in a predetermined direction, the rolling motion of the primary roller results in a tilting thereof in respect to said horizontal support surface due to one of the following: (i) the longitudinal movement of said secondary roller toward said left end, (ii) the longitudinal movement of said secondary roller toward said right end.

2. The rolling toy of claim 1, wherein said at least one rolling body comprises a first rolling body.

3. The rolling toy of claim 2, wherein a center of gravity of said primary roller is located approximately at a location of a vertical plane, substantially perpendicular to the longitudinal axis, and associated with said first rolling body.

4. The rolling toy of claim 1, wherein said at least one rolling body comprises a left rolling body and a right rolling body spaced apart along said longitudinal axis and having an equal outer diameter.

5. The rolling toy of claim 1, wherein said secondary roller is configured as an elongated body extending along a longitudinal axis and having a helical ridge extending outwardly from an exterior thereof, wherein the helical ridge has at least one complete revolution around the longitudinal axis, thereby the helical ridge constitutes said helical guiding means.

6. The rolling toy of claim 1, wherein said secondary roller is configured as a helical spring having at least one complete revolution, thereby the helical spring constitutes said helical guiding means.

7. The rolling toy of claim 1, wherein a plurality of circular ridges spaced apart along said longitudinal axis extend inwardly from said substantially cylindrical interior surface.

8. The rolling toy of claim 1, wherein said tubular member has a helical ridge extending inwardly from said substantially cylindrical interior surface and having at least one complete revolution around said longitudinal axis of said tubular member, thereby the helical ridge constitutes said helical guiding means; said secondary roller is configured for a rolling engagement with the helical ridge.

9. The rolling toy of claim 1, wherein said tubular member is formed substantially as a helical spring having at least one complete revolution, thereby the helical spring constitutes said helical guiding means; said secondary roller is configured for a rolling engagement with the helical spring.

10. The rolling toy of claim 1, wherein said secondary roller has a rotation-symmetrical shape.

11. The rolling toy of claim 1, wherein said secondary roller is configured as an elongated body extending along a longitudinal axis and having at least one circular ridge extending outwardly from an exterior of the elongated body and coaxial with the longitudinal axis.

12. A rolling toy comprising:

a primary roller and a secondary roller;

said primary roller has a tubular member extending along a longitudinal axis thereof between a left end and a right end;

said primary roller further has at least one rolling body which is fixedly attached to said tubular member and is coaxial thereto;

said at least one rolling body is configured such that said primary roller is rollable on the at least one rolling body on a horizontal support surface;

said tubular member has a substantially cylindrical interior surface facing an interior thereof;

said secondary roller is sized to fit within said tubular member and is adapted for a rolling motion on said substantially cylindrical interior surface;

wherein at least one of the following includes a helical guiding means: (i) said tubular member and (ii) said secondary roller;

said helical guiding means has at least one complete revolution of the helix thereof and is configured for urging said secondary roller to move longitudinally toward said left end or said right end when said secondary roller is in the rolling motion on said substantially cylindrical interior surface;

an outer diameter of said at least one rolling body is at least twenty-five percent larger than a diameter of an imaginary cylinder associated with said substantially cylindrical interior surface;

a configuration of the primary roller and weights of the primary and secondary rollers are such that, as said primary roller is positioned on said horizontal support surface having said longitudinal axis oriented horizontally, at least one of the following is satisfied:

(a) when said secondary roller is disposed on said substantially cylindrical interior surface in a position closest to said left end of said tubular member, a center of gravity of said rolling toy is located to the left of a vertical plane, perpendicular to said longitudinal axis, and crossing a leftmost point of contact of said at least one rolling body with said horizontal support surface, or (b) when said secondary roller is disposed on said substantially cylindrical interior surface in a position closest to said right end of said tubular member, a center of gravity of said rolling toy is located to the right of a vertical plane, perpendicular to said longitudinal axis, and crossing a rightmost point of contact of said at least one rolling body with said horizontal support surface;

thereby, when said secondary roller is disposed on said substantially cylindrical interior surface in a predetermined location and said primary roller is set in a rolling motion on said horizontal support surface in a predetermined direction, the rolling motion of the primary roller results in a tilting thereof in respect to said horizontal support surface due to one of the following: (i) the longitudinal movement of said secondary roller toward said left end, (ii) the longitudinal movement of said secondary roller toward said right end.

13. The rolling toy of claim 12, wherein said at least one rolling body comprises a first rolling body.

14. The rolling toy of claim 13, wherein a center of gravity of said primary roller is located approximately at a location of a vertical plane, substantially perpendicular to the longitudinal axis, and associated with said first rolling body.

15. The rolling toy of claim 12, wherein said at least one rolling body comprises a left rolling body and a right rolling body spaced apart along said longitudinal axis and having an equal outer diameter.

16. The rolling toy of claim 12, wherein said secondary roller is configured as an elongated body extending along a longitudinal axis and having a helical ridge extending outwardly from an exterior thereof, wherein the helical ridge has at least one complete revolution around the longitudinal axis thereby the helical ridge constitutes said helical guiding means.

17. The rolling toy of claim 12, wherein a plurality of circular ridges spaced apart along said longitudinal axis extend inwardly from said substantially cylindrical interior surface.

18. The rolling toy of claim 12, wherein said tubular member has a helical ridge extending inwardly from said substantially cylindrical interior surface and having at least one complete revolution around said longitudinal axis of said tubular member, thereby the helical ridge constitutes said helical guiding means; said secondary roller is configured for a rolling engagement with the helical ridge.

19. The rolling toy of claim 12, wherein said secondary roller has a rotation-symmetrical shape.

20. A rolling toy comprising:

a primary roller and a secondary roller;

said primary roller has a tubular member extending along a longitudinal axis thereof between a left end and a right end;

said primary roller further has at least one rolling body fixedly attached to said tubular member and is coaxial thereto;

said at least one rolling body is configured such that said primary roller is rollable on the at least one rolling body on a horizontal support surface;

said tubular member has a substantially cylindrical interior surface facing an interior thereof;

said secondary roller is sized to fit within said tubular member and is adapted for a rolling motion on said substantially cylindrical interior surface;

wherein at least one of the following includes a helical guiding means: (i) said tubular member and (ii) said secondary roller;

said helical guiding means has at least one complete revolution of the helix thereof and is configured for urging said secondary roller to move longitudinally toward said left end or said right end when said secondary roller is in the rolling motion on said substantially cylindrical interior surface;

a configuration of the primary roller and weights of the primary and secondary rollers are such that, as the primary roller is positioned on said horizontal support surface, at least one of the following is satisfied:

(a) said primary roller is urged to tilt to the left when said secondary roller is positioned on said substantially cylindrical interior surface in a position closest to said left end of said tubular member, (b) said primary roller is urged to tilt to the right when said secondary roller is positioned on said substantially cylindrical interior surface in a position closest to said right end of said tubular member, thereby, when said secondary roller is disposed on said substantially cylindrical interior surface in a predetermined location and said primary roller is set in a rolling motion on said horizontal support surface in a predetermined direction, the rolling motion of the primary roller results in a tilting thereof in respect to said horizontal support surface due to one of the following: (i) the longitudinal movement of said secondary roller toward said left end, (ii) the longitudinal movement of said secondary roller toward said right end.

* * * * *